US006302377B1

(12) United States Patent
Pimentel

(10) Patent No.: US 6,302,377 B1
(45) Date of Patent: Oct. 16, 2001

(54) POST PULLING APPARATUS

(76) Inventor: Martin Pimentel, 1310 SW., 5th Ave., Battle Ground, WA (US) 98604

( * ) Notice: Subject to any disclaimer, the term of this patent is extended or adjusted under 35 U.S.C. 154(b) by 0 days.

(21) Appl. No.: 09/621,973

(22) Filed: Jul. 21, 2000

(51) Int. Cl.[7] ..... B66F 3/00
(52) U.S. Cl. ..... 254/30; 254/95
(58) Field of Search ..... 254/30, 29 R, 254/95, 97, 132

(56) References Cited

U.S. PATENT DOCUMENTS

D. 361,248 8/1995 Harper et al. .
3,358,967 * 12/1967 Harmon ..... 254/30
4,161,310 7/1979 Parker .
4,354,375 * 10/1982 Lesowsky ..... 254/95
4,422,621 12/1983 Ekern .
4,750,711 6/1988 Landry .
5,009,394 * 4/1991 Marshall ..... 254/30
5,211,374 5/1993 Head et al. .
5,224,687 7/1993 Geckler et al. .

* cited by examiner

*Primary Examiner*—Robert C. Watson

(57) ABSTRACT

A post pulling apparatus for pulling and removing posts from a ground. The post pulling apparatus includes a base assembly having a base member and having a plurality of wheel members securely mounted to the base member; and also includes an elongate support member being vertically disposed upon the base member and having an open top end and a bore extending therethrough; and further includes a post pulling assembly for pulling a post out of a ground.

14 Claims, 5 Drawing Sheets

POST PULLING APPARATUS

BACKGROUND OF THE INVENTION

1. Field of the Invention

The present invention relates to a post puller and more particularly pertains to a new post pulling apparatus for pulling and removing posts from a ground.

2. Description of the Prior Art

The use of a post puller is known in the prior art. More specifically, a post puller heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,422,621; 5,224,687; 4,750,711; 4,161,310; 5,211,374; and U.S. Pat. No. Des. 361,248.

While these devices fulfill their respective, particular objectives and requirements, the aforementioned patents do not disclose a new post pulling apparatus. The inventive device includes a base assembly having a base member and having a plurality of wheel members securely mounted to the base member; and also includes an elongate support member being vertically disposed upon the base member and having an open top end and a bore extending therethrough; and further includes a post pulling assembly for pulling a post out of a ground.

In these respects, the post pulling apparatus according to the present invention substantially departs from the conventional concepts and designs of the prior art, and in so doing provides an apparatus primarily developed for the purpose of pulling and removing posts from a ground.

SUMMARY OF THE INVENTION

In view of the foregoing disadvantages inherent in the known types of post puller now present in the prior art, the present invention provides a new post pulling apparatus construction wherein the same can be utilized for pulling and removing posts from a ground.

The general purpose of the present invention, which will be described subsequently in greater detail, is to provide a new post pulling apparatus which has many of the advantages of the post puller mentioned heretofore and many novel features that result in a new post pulling apparatus which is not anticipated, rendered obvious, suggested, or even implied by any of the prior art post puller, either alone or in any combination thereof.

To attain this, the present invention generally comprises a base assembly having a base member and having a plurality of wheel members securely mounted to the base member; and also includes an elongate support member being vertically disposed upon the base member and having an open top end and a bore extending therethrough; and further includes a post pulling assembly for pulling a post out of a ground.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new post pulling apparatus which has many of the advantages of the post puller mentioned heretofore and many novel features that result in a new post pulling apparatus which is not anticipated, rendered obvious, suggested, or even implied by any of the prior art post puller, either alone or in any combination thereof.

It is another object of the present invention to provide a new post pulling apparatus which may be easily and efficiently manufactured and marketed.

It is a further object of the present invention to provide a new post pulling apparatus which is of a durable and reliable construction.

An even further object of the present invention is to provide a new post pulling apparatus which is susceptible of a low cost of manufacture with regard to both materials and labor, and which accordingly is then susceptible of low prices of sale to the consuming public, thereby making such post pulling apparatus economically available to the buying public.

Still yet another object of the present invention is to provide a new post pulling apparatus which provides in the apparatuses and methods of the prior art some of the advantages thereof, while simultaneously overcoming some of the disadvantages normally associated therewith.

Still another object of the present invention is to provide a new post pulling apparatus for pulling and removing posts from a ground.

Yet another object of the present invention is to provide a new post pulling apparatus which includes a base assembly having a base member and having a plurality of wheel members securely mounted to the base member; and also includes an elongate support member being vertically disposed upon the base member and having an open top end and a bore extending therethrough; and further includes a post pulling assembly for pulling a post out of a ground.

Still yet another object of the present invention is to provide a new post pulling apparatus that is easy and convenient to use to remove posts from the ground.

Even still another object of the present invention is to provide a new post pulling apparatus that can be easily and conveniently moved or wheeled upon the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
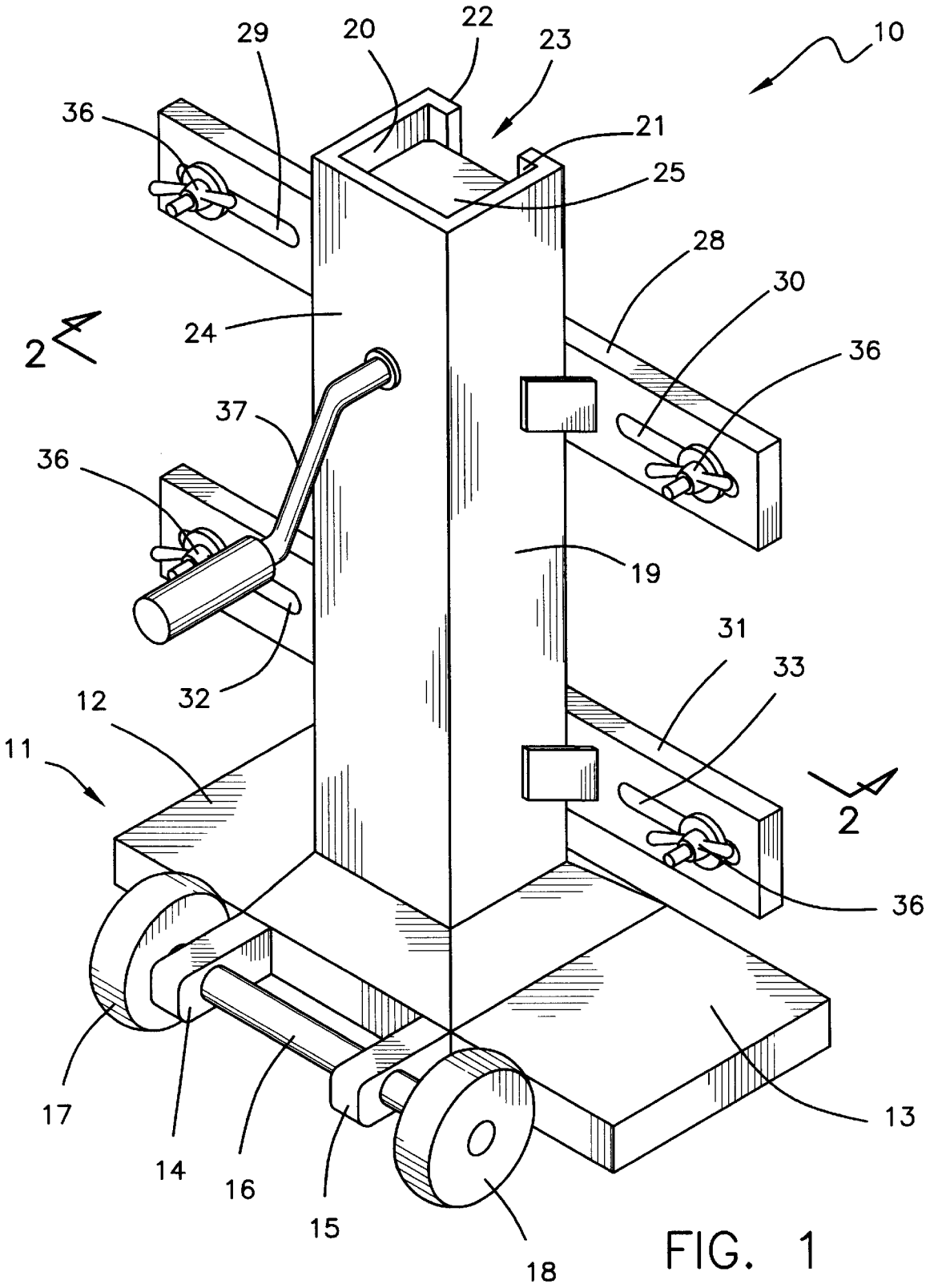
FIG. 1 is a perspective view of a new post pulling apparatus according to the present invention.
Figure 2:
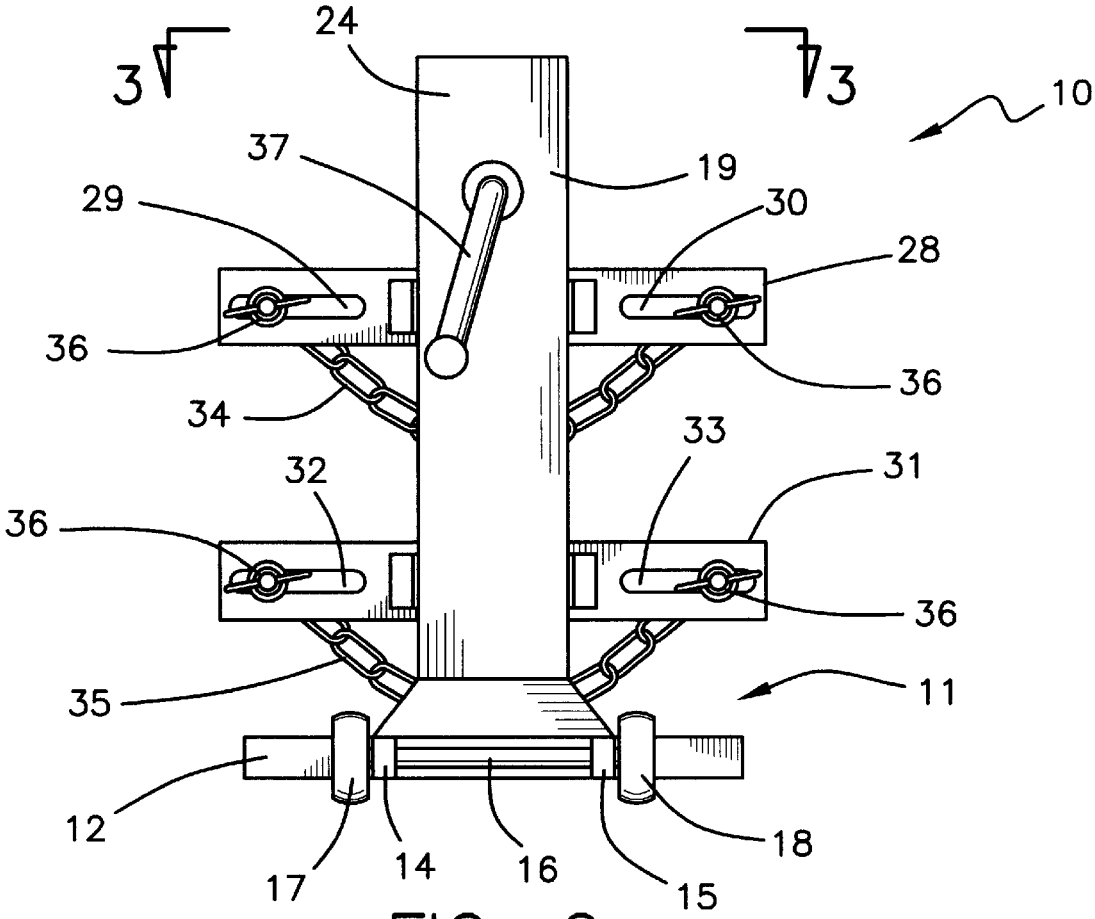
FIG. 2 is a rear elevational view of the present invention.
Figure 3:
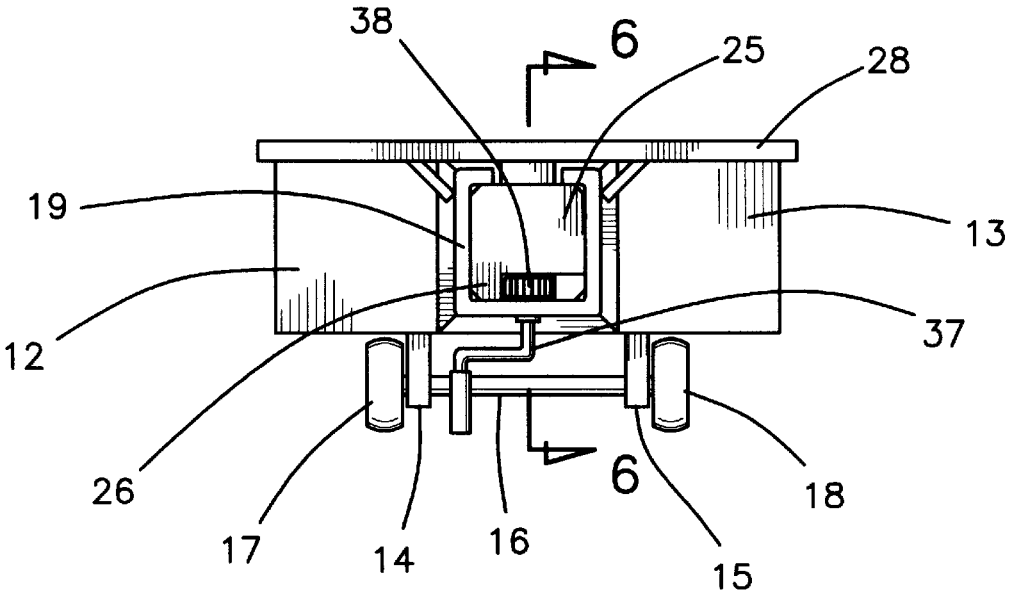
FIG. 3 is a top plan view of the present invention.
Figure 4:
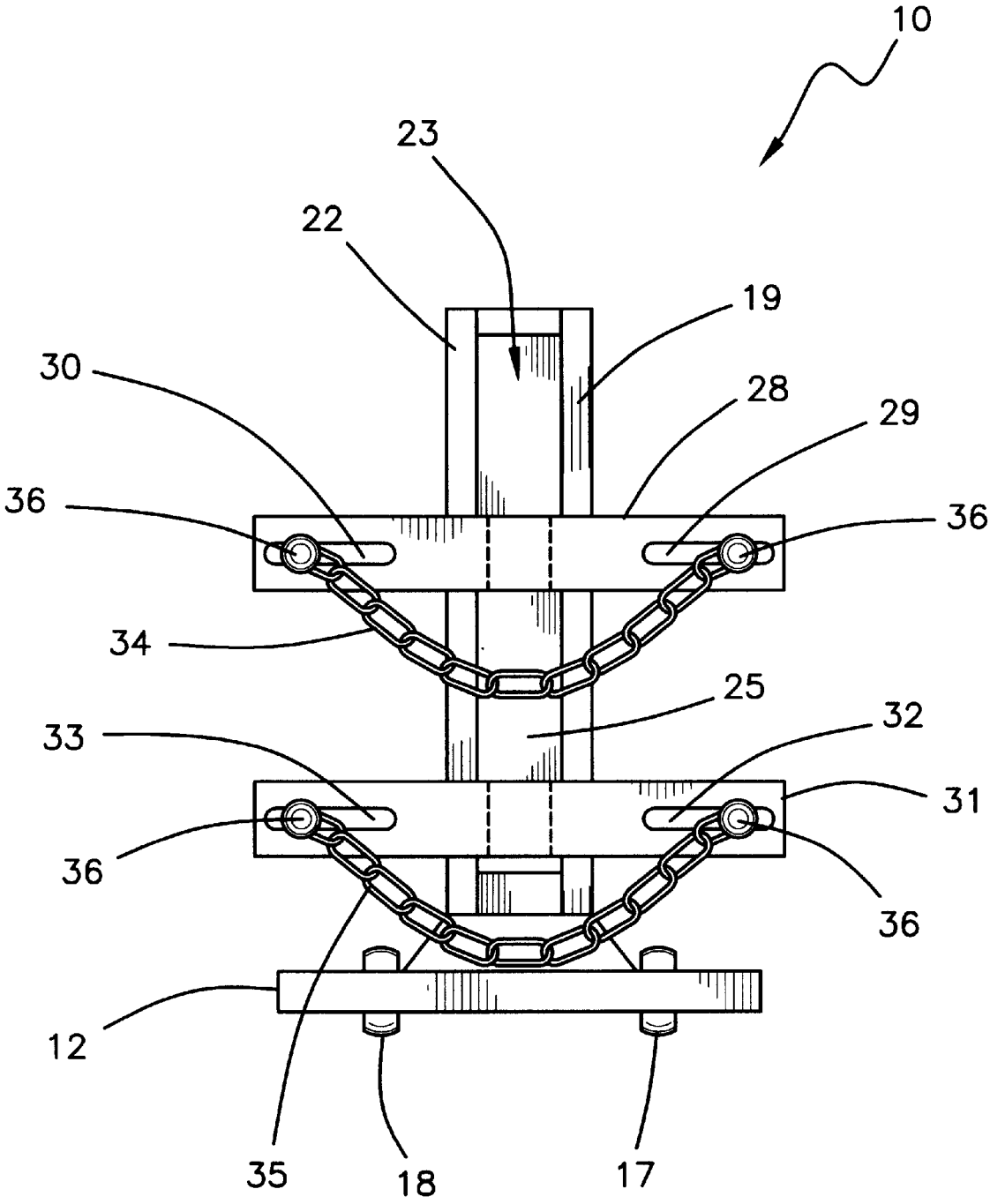
FIG. 4 is a front elevational view of the present invention.
Figure 5:
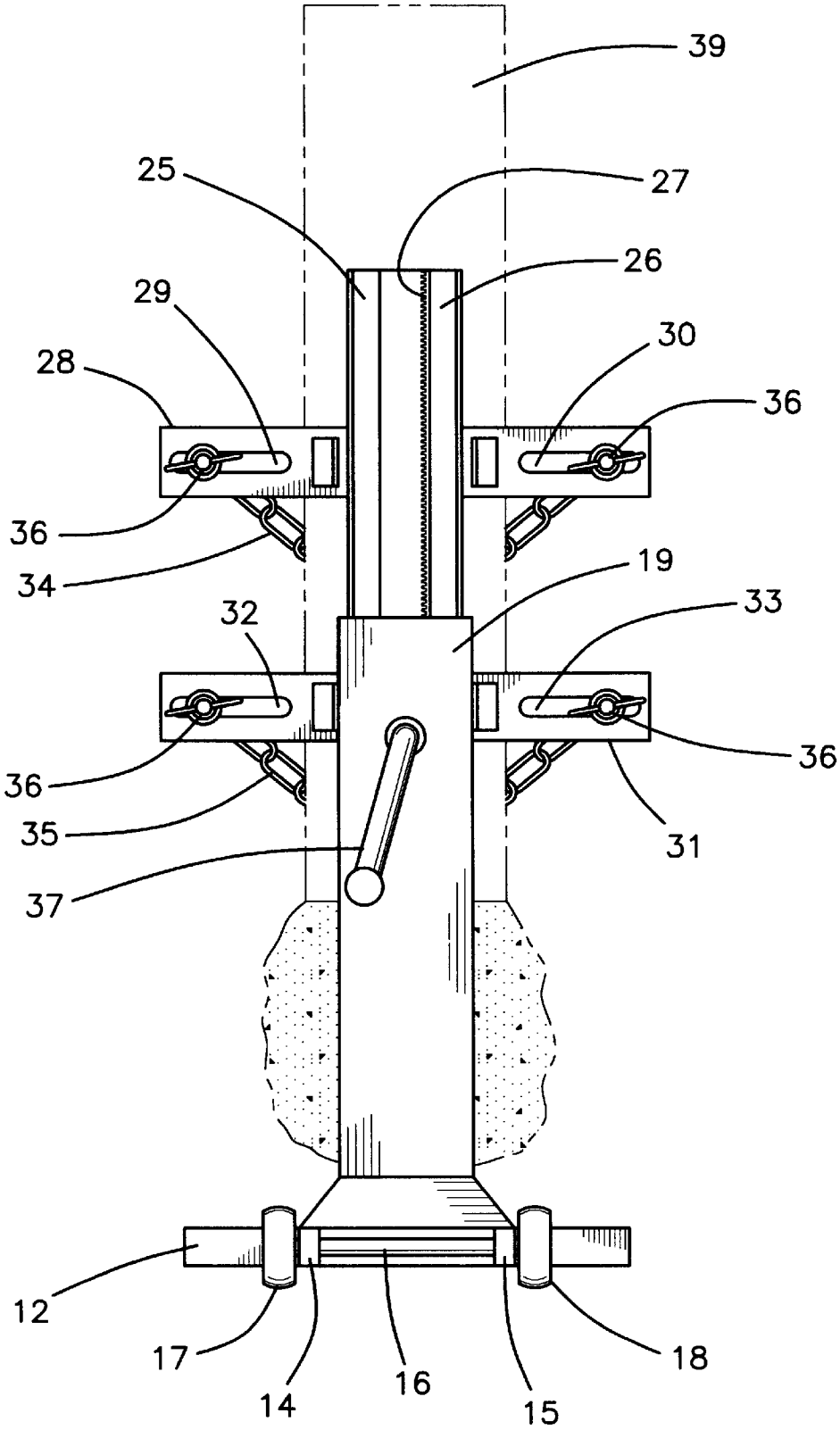
FIG. 5 is a rear elevational view of the present invention shown in use.
Figure 6:
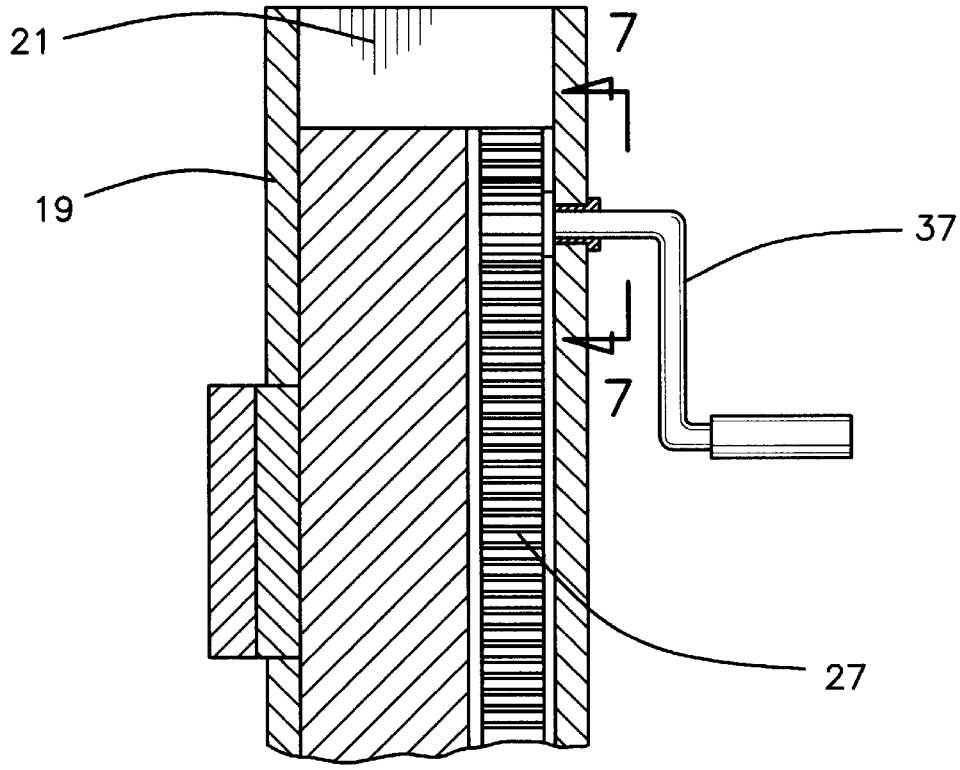
FIG. 6 is a cross-sectional view of the elongate lift member and the elongate support member of the present invention.
Figure 7:
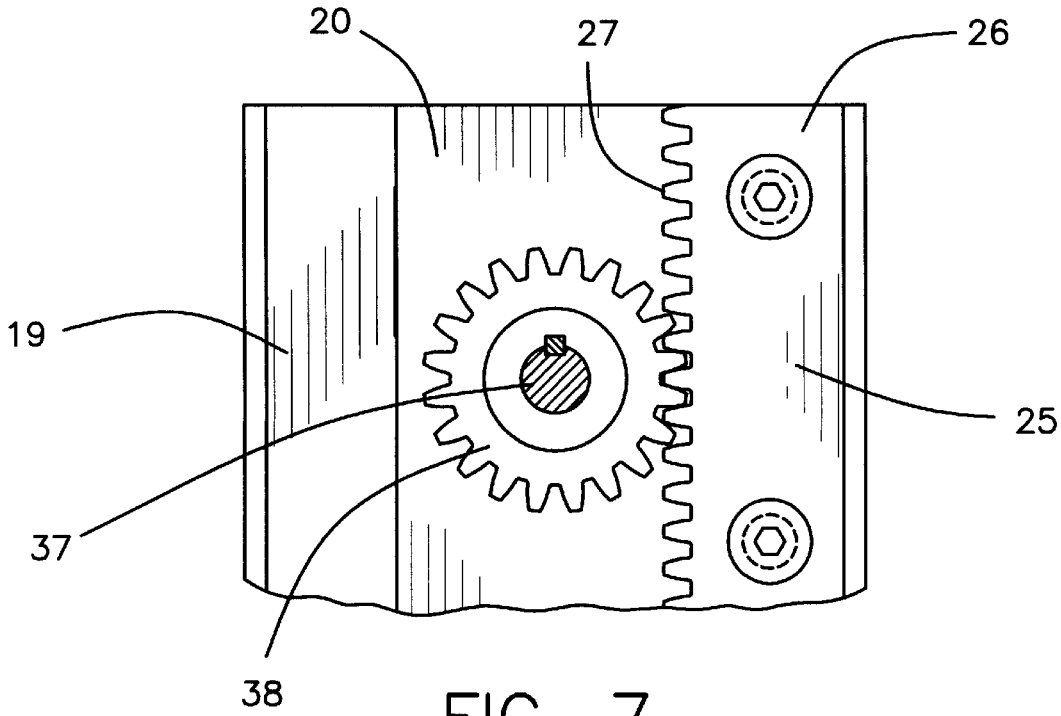
FIG. 7 is a detailed elevational view of the sprocket member and the teeth along the flange portion of the present invention.

With reference now to the drawings, and in particular to FIGS. 1 through 7 thereof, a new post pulling apparatus embodying the principles and concepts of the present invention and generally designated by the reference numeral 10 will be described.

As best illustrated in FIGS. 1 through 7, the post pulling apparatus 10 generally comprises a base assembly 11 having a base member 12 and having a plurality of wheel members 17,18 securely mounted to the base member 12. The base assembly 11 further includes bracket members 14,15 securely and conventionally attached and welded to the base member 12 and also includes an axle member 16 rotatably mounted to the bracket members 14,15 with the wheel members 17,18 being mounted to the axle member 16.

An elongate support member 19 is vertically and conventionally disposed upon the base member 12 and has an open top end 21 and a bore 20 extending therethrough. The base member 12 has a top side 13 upon which the elongate support member 19 is securely and conventionally mounted. The elongate support member 19 has a front wall 22 and an opening 23 extending in the front wall 22 and extending along a length of the front wall 22.

A means for pulling a post 39 out of a ground includes an elongate lift member 25 which is movably disposed in and extendable from the bore 20 of the elongate support member 19, and also includes brace members 28,31 being securely and conventionally attached to the elongate lift member 25, and further includes chain members 34,35 being conventionally attached to the brace members 28,31 for attaching about a post 39, and also includes a crank 37 for raising and lowering the elongate lift member 25, and further includes a sprocket member 38 being attached to the crank 37 and being engaged to the elongate lift member 25. The elongate lift member 25 includes a flange portion 26 extending from a side thereof and having a plurality of teeth 27 extending along a length of the flange portion 26. Each of the brace members 28,31 includes slots 29,30,32,33 extending therethrough near ends thereof and each of the brace members 28,31 extends across the elongate lift member 25 with the brace members 28,31 being spaced apart. The chain members 34,35 have ends which are adjustably fastened to fastening members 36 which are adjustably mounted in the slots 29,30,32,33 of the brace members 28,31 with each of the chain members 34,35 being adjustably mounted to a respective brace member 28,31. The crank 37 is journaled through a back wall 24 of the elongate support member 19, and the sprocket member 38 is engaged to the teeth 27 of the flange portion 26 of the elongate lift member 25.

In use, the user positions the post pulling apparatus 10 up against a post 39 to be pulled out of a ground with the chain members 34,35 being wrapped about the post 39. The user then turns the crank 37 which raises the elongate lift member 25 and the chain members 34,35 which urge the post 39 upwardly out of the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post pulling apparatus comprising:

a base assembly having a base member and having a plurality of wheel members securely mounted to said base member;

an elongate support member being vertically disposed upon said base member and having an open top end and a bore extending therethrough;

a means for pulling a post out of a ground;

wherein said base member has a top side upon which said elongate support member is securely mounted;

wherein said base assembly further includes bracket members securely attached to said base member and also includes an axle member rotatably mounted to said bracket members, said wheel members being mounted to said axle member;

wherein said elongate support member has a front wall and an opening extending in said front wall and extending a length of said front wall;

wherein said means for pulling a post out of a ground includes an elongate lift member which is movably disposed in and extendable from said bore of said elongate support member, and also includes brace members being securely attached to said elongate lift member, and further includes chain members attached to said brace members for attaching about a post, and also includes a crank for raising and lowering said elongate lift member, and further includes a sprocket member being attached to said crank and being engaged to said elongate lift member.

2. A post pulling apparatus as described in claim 1, wherein said elongate lift member includes a flange portion extending from a side thereof and having a plurality of teeth extending along a length of said flange portion.

3. A post pulling apparatus as described in claim 1, wherein each of said brace members includes slots extending therethrough near ends thereof, each of said brace members extending across said elongate lift member, said brace members being spaced apart.

4. A post pulling apparatus as described in claim 3, wherein said chain members have ends which are adjustably fastened to fastening members which are adjustably mounted in said slots of said brace members, each of said chain members being adjustably mounted to a respective said brace member.

5. A post pulling apparatus as described in claim 2, wherein said crank is journaled through a back wall of said elongate support member, and said sprocket member is engaged to said teeth of said flange portion of said elongate lift member.

6. A post pulling apparatus comprising:

a base assembly having a base member and having a plurality of wheel members securely mounted to said base member, said base assembly further including bracket members securely attached to said base member and also includes an axle member rotatably mounted to said bracket members, said wheel members being mounted to said axle member;

an elongate support member being vertically disposed upon said base member and having an open top end and a bore extending therethrough, said base member having a top side upon which said elongate support member is securely mounted, said elongate support member having a front wall and an opening extending in said front wall and extending a length of said front wall; and a means for pulling a post out of a ground including an elongate lift member which is movably disposed in and extendable from said bore of said elongate support member, and also including brace members being securely attached to said elongate lift member, and further including chain members attached to said brace members for attaching about a post, and also including a crank for raising and lowering said elongate lift member, and further including a sprocket member being attached to said crank and being engaged to said elongate lift member, said elongate lift member including a flange portion extending from a side thereof and having a plurality of teeth extending along a length of said flange portion, each of said brace members including slots extending therethrough near ends thereof, each of said brace members extending across said elongate lift member, said brace members being spaced apart, said chain members having ends which are adjustably fastened to fastening members which are adjustably mounted in said slots of said brace members, each of said chain members being adjustably mounted to a respective said brace member, said crank being journaled through a back wall of said elongate support member, and said sprocket member is engaged to said teeth of said flange portion of said elongate lift member.

7. A post pulling apparatus comprising:

a base assembly having a base member and having a plurality of wheel members securely mounted to said base member;

an elongate support member being vertically disposed upon said base member and having an open top end and a bore extending therethrough;

a means for pulling a post out of a ground; and wherein said means for pulling a post out of a ground includes an elongate lift member which is movably disposed in and extendable from said bore of said elongate support member, and also includes brace members being securely attached to said elongate lift member, and further includes chain members attached to said brace members for attaching about a post, and also includes a crank for raising and lowering said elongate lift member, and further includes a sprocket member being attached to said crank and being engaged to said elongate lift member.

8. A post pulling apparatus as described in claim 7, wherein said base member has a top side upon which said elongate support member is securely mounted.

9. A post pulling apparatus as described in claim 7, wherein said base assembly further includes bracket members securely attached to said base member and also includes an axle member rotatably mounted to said bracket members, said wheel members being mounted to said axle member.

10. A post pulling apparatus as described in claim 7, wherein said elongate support member has a front wall and an opening extending in said front wall and extending a length of said front wall.

11. A post pulling apparatus as described in claim 7, wherein said elongate lift member includes a flange portion extending from a side thereof and having a plurality of teeth extending along, a length of said flange portion.

12. A post pulling apparatus as described in claim 7, wherein each of said brace members includes slots extending therethrough near ends thereof, each of said brace members extending across said elongate lift member, said brace members being spaced apart.

13. A post pulling apparatus as described in claim 7, wherein said chain members have ends which are adjustably fastened to fastening members which arc adjustably mounted in said slots of said brace members, each of said chain members being adjustably mounted to a respective said brace member.

14. A post pulling apparatus as described in claim 12, wherein said crank is journaled through a back wall of said elongate support member, and said sprocket member is engaged to said teeth of said flange portion of said elongate lift member.

* * * * *